US009400470B1

(12) United States Patent
Miyoshi

(10) Patent No.: US 9,400,470 B1
(45) Date of Patent: Jul. 26, 2016

(54) LIFESPAN DETERMINATION DEVICE AND IMAGE FORMING APPARATUS

(71) Applicant: FUJI XEROX CO., LTD., Tokyo (JP)

(72) Inventor: Noriyuki Miyoshi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/851,896

(22) Filed: Sep. 11, 2015

(30) Foreign Application Priority Data

Feb. 19, 2015 (JP) ..... 2015-030139

(51) Int. Cl.
*G03G 15/20* (2006.01)
*G03G 15/00* (2006.01)

(52) U.S. Cl.
CPC ..... *G03G 15/553* (2013.01); *G03G 15/5029* (2013.01); *G03G 15/55* (2013.01); *G03G 2221/1663* (2013.01)

(58) Field of Classification Search
CPC . G03G 15/5029; G03G 15/55; G03G 15/553; G03G 2221/1663
USPC ..... 399/33, 43, 45
See application file for complete search history.

(56) References Cited

U.S. PATENT DOCUMENTS 6,285,838 B1 * 9/2001 Able ..... G03G 15/2003 399/45
2005/0058468 A1 * 3/2005 Reynolds ..... G03G 21/02 399/79

FOREIGN PATENT DOCUMENTS

JP 63-008755 A 1/1988

* cited by examiner

*Primary Examiner* — Benjamin Schmitt
(74) *Attorney, Agent, or Firm* — Sughrue Mion, PLLC

(57) ABSTRACT

A lifespan determination device determines a lifespan of a fixing unit including a heating member and a pressing member and fixing a toner image onto a sheet passing through a feed area therebetween. The device includes a counting unit, a determining unit, and a notifying unit. The counting unit includes counters for respective sheet widths and adds, to a count value of a counter corresponding to a sheet width of the fed sheet, a count value obtained by multiplying the number of fed sheets having the sheet width by a first weight coefficient corresponding to a degree of damage given to the fixing unit by the fed sheet. The determining unit determines whether or not a count value of any one of the counters has reached a predetermined value. The notifying unit provides a notification indicating that the lifespan is reached if the count value has reached the predetermined value.

10 Claims, 5 Drawing Sheets

| JOB | PRINT CONDITION | GROUP | SHEET LENGTH (mm) | NUMBER OF PRINT SHEETS (K SHEETS) | WHOLE-SURFACE-ABRASION COUNT-VALUE ADDITION COEFFICIENT | EDGE-ABRASION COUNT-VALUE ADDITION COEFFICIENT | EDGE-ABRASION COUNT-VALUE SUBTRACTION COEFFICIENT |
|---|---|---|---|---|---|---|---|
| 0 | – | – | | 0 | 0 | 0 | 0 |
| 1 | 300 gsmA4-SEF | 4 | 297 | 36 | 1.4 | 4 | 4.3 |
| 2 | 64 gsmB4 | 3 | 364 | 20 | 1 | 2 | 0.6 |
| 3 | 64 gsmA3 | 2 | 420 | 35 | 1 | 2 | 0.6 |

FIG. 2

| GROUP | SHEET WIDTH (mm) | REPRESENTATIVE SHEET SIZE | COUNT-VALUE DECREMENT TARGET ○: YES ×: NO |
|---|---|---|---|
| GROUP 0 (WHOLE-SURFACE ABRASION COUNTER) | WHOLE REGION | WHOLE REGION | × |
| GROUP 1 | 320 TO 330 | SRA3 | × |
| GROUP 2 | 319 TO 295 | A3 | ○ |
| GROUP 3 | 294 TO 255 | B4 | ○ |
| GROUP 4 | 254 TO 208 | A4−SEF | ○ |
| GROUP 5 | 207 TO 180 | B5−SEF | ○ |
| GROUP 6 | 98 TO 179 | POSTCARD | ○ |

FIG. 3

| BASIS-WEIGHT RANGE | WHOLE-SURFACE-ABRASION COUNT-VALUE ADDITION COEFFICIENT | EDGE-ABRASION COUNT-VALUE ADDITION COEFFICIENT | EDGE-ABRASION COUNT-VALUE SUBTRACTION COEFFICIENT |
|---|---|---|---|
| LESS THAN 64 gsm | 1 | 2 | 0.6 |
| 65 TO 120 gsm | 1.1 | 2.5 | 0.8 |
| 121 TO 157 gsm | 1.2 | 3 | 2 |
| 158 TO 210 gsm | 1.3 | 3.5 | 2.8 |
| 211 TO 300 gsm | 1.4 | 4 | 4.3 |

FIG. 4A

| JOB | PRINT CONDITION | GROUP | SHEET LENGTH (mm) | NUMBER OF PRINT SHEETS (K SHEETS) | WHOLE-SURFACE-ABRASION COUNT-VALUE ADDITION COEFFICIENT | EDGE-ABRASION COUNT-VALUE ADDITION COEFFICIENT | EDGE-ABRASION COUNT-VALUE SUBTRACTION COEFFICIENT |
|---|---|---|---|---|---|---|---|
| 0 | – | – | | 0 | 0 | 0 | 0 |
| 1 | 300 gsmA4-SEF | 4 | 297 | 36 | 1.4 | 4 | 4.3 |
| 2 | 64 gsmB4 | 3 | 364 | 20 | 1 | 2 | 0.6 |
| 3 | 64 gsmA3 | 2 | 420 | 35 | 1 | 2 | 0.6 |

FIG. 4B

| JOB | COUNT VALUE OF COUNTER | | | | | | |
|---|---|---|---|---|---|---|---|
| | GROUP 0 | GROUP 1 | GROUP 2 | GROUP 3 | GROUP 4 | GROUP 5 | GROUP 6 |
| | (WHOLE-SURFACE ABRASION) | SRA3 | A3 | B4 | A4-SEF | B5-SEF | POSTCARD |
| | | 320 TO 330 | 295 TO 319 | 255 TO 294 | 208 TO 254 | 180 TO 207 | 98 TO 179 |
| 0 | 0.0 | 0.0 | 0.0 | 0.0 | 0.0 | 0.0 | 0.0 |
| 1 | 71.3 | 0.0 | 0.0 | 0.0 | 203.7 | 0.0 | 0.0 |
| 2 | 105.9 | 0.0 | 0.0 | 69.3 | 182.9 | 0.0 | 0.0 |
| 3 | 175.9 | 0.0 | 140.0 | 27.3 | 140.9 | 0.0 | 0.0 |

FIG. 4C

| (ACCUMULATIVE SHEET LENGTH) ×(NUMBER OF PRINT SHEETS)/210 (COMPARATIVE EXAMPLE) |
|---|
| 0.0 |
| 50.9 |
| 85.6 |
| 155.6 |

LIFESPAN DETERMINATION DEVICE AND IMAGE FORMING APPARATUS

CROSS-REFERENCE TO RELATED APPLICATIONS

This application is based on and claims priority under 35 USC 119 from Japanese Patent Application No. 2015-030139 filed Feb. 19, 2015.

BACKGROUND

Technical Field

The present invention relates to lifespan determination devices and image forming apparatuses.

SUMMARY

According to an aspect of the invention, there is provided a lifespan determination device that determines a lifespan of a fixing unit. The fixing unit includes a heating rotatable member and a pressing member. The heating rotatable member is equipped with a heat source. The pressing member applies pressure onto a sheet passing through a feed area between the pressing member and the heating rotatable member. The fixing unit fixes a toner image on the sheet onto the sheet as the sheet having the toner image thereon passes through the feed area. The lifespan determination device includes a counting unit, a determining unit, and a notifying unit. The counting unit includes counters for respective sheet widths, each of which is a dimension in a width direction orthogonal to a sheet feed direction of the sheet passing through the feed area. The counting unit adds, to a count value of a counter corresponding to a sheet width of the sheet passing through the feed area, a count value obtained by multiplying the number of fed sheets having the sheet width by a first weight coefficient corresponding to a degree of damage given to the fixing unit by the fed sheet. The determining unit determines whether or not a count value of any one of the counters for the respective sheet widths has reached a predetermined value. The notifying unit provides a notification indicating that the fixing unit has reached the lifespan if the determining unit determines that the count value of any one of the counters has reached the predetermined value.

BRIEF DESCRIPTION OF THE DRAWINGS

An exemplary embodiment of the present invention will be described in detail based on the following figures, wherein:

FIG. 2 illustrates an example of groups corresponding to respective sheet widths;

FIG. 3 illustrates count-value addition and subtraction coefficients relative to basis weights of sheets;

FIGS. 4A to 4C illustrate an example in which the count value of each counter is incremented or decremented in accordance with this exemplary embodiment.

DETAILED DESCRIPTION

An exemplary embodiment of the present invention will be described below.

Figure 1:
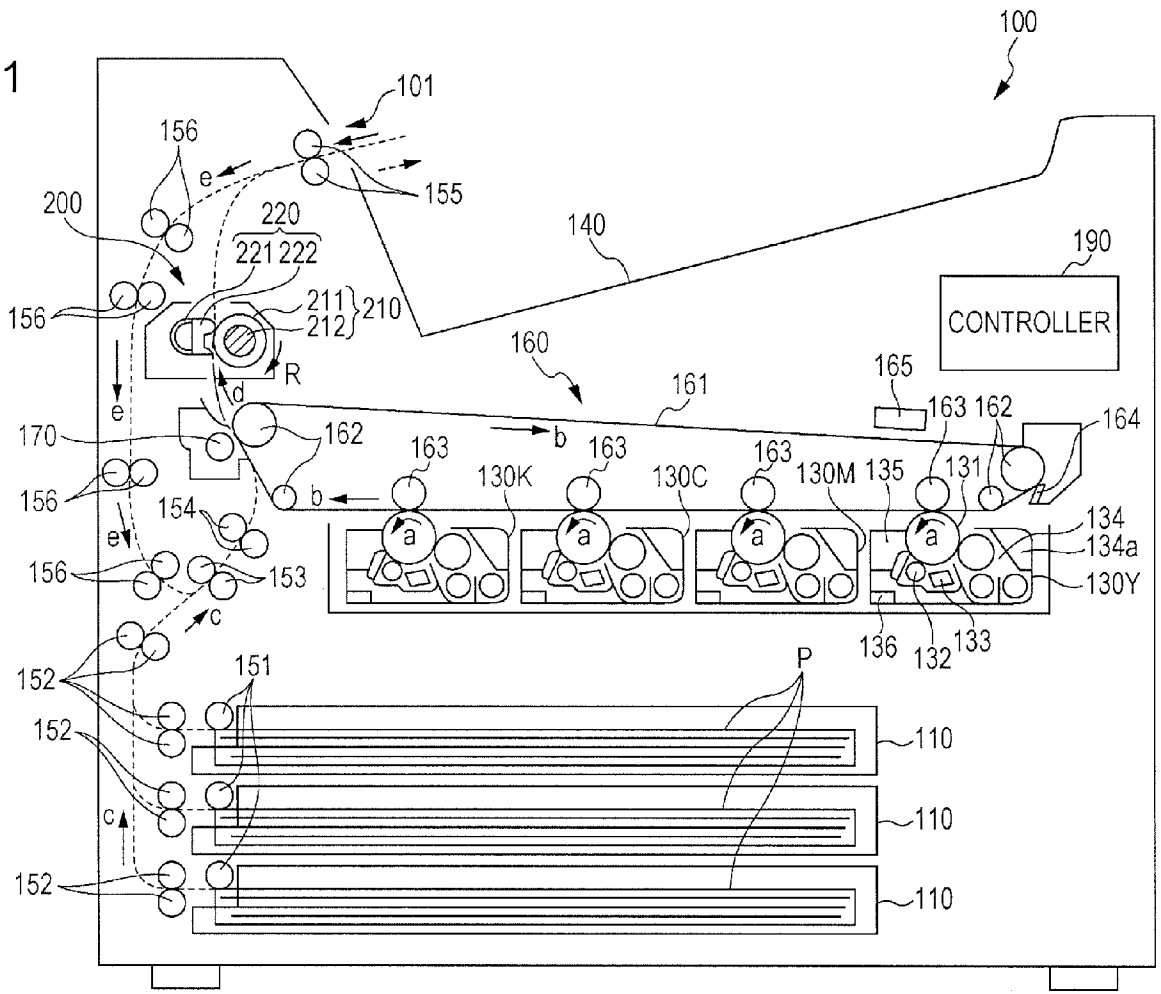
FIG. 1 illustrates an internal configuration of a printer as an image forming apparatus according to an exemplary embodiment of the present invention.

FIG. 1 illustrates an internal configuration of a printer 100 as an image forming apparatus according to an exemplary embodiment of the present invention. The printer 100 includes a lifespan determination device according to an exemplary embodiment of the present invention.

Three drawer-type sheet trays 110 are provided at a lower portion of the printer 100. These sheet trays 110 individually accommodate sheets P of different kinds in a stacked state. When performing image printing, the sheets P are picked up one-by-one from a designated one of the sheet trays 110 by a corresponding pickup roller 151 and are transported by transport rollers 152. A sheet transport operation will be described later.

Furthermore, four image forming engines 130 are installed in this printer 100. These four image forming engines 130 are detachable. Each image forming engine 130 accommodates a monochromatic toner and forms a monochromatic toner image by using this monochromatic toner.

When expressing the toner colors with regard to the image forming engines 130, Y (yellow), M (magenta), C (cyan), and K (black), which are signs that indicate the toner colors, are further added to the reference sign "130" indicating the image forming engines.

In this exemplary embodiment, the image forming engines 130 all have identical configurations. Each image forming engine 130 includes a photoconductor 131 that rotates in a direction indicated by an arrow a, a charging unit 132, an exposure unit 133, a developing unit 134, and a cleaner 135. The units 132 to 135 are arranged around the photoconductor 131.

The charging unit 132 uniformly charges the surface of the photoconductor 131.

The exposure unit 133 radiates exposure light modulated based on image data onto the photoconductor 131 so as to form an electrostatic latent image on the photoconductor 131. Each image forming engine 130 receives image data expressing a monochromatic image to be formed using the toner of the corresponding color that the image forming engine 130 is in charge of. The exposure unit 133 radiates exposure light modulated based on the image data expressing that monochromatic image, so that an electrostatic latent image corresponding to that monochromatic image is formed on the photoconductor 131.

The developing unit 134 develops the electrostatic latent image on the photoconductor 131 by using the corresponding toner so as to form a monochromatic toner image on the photoconductor 131. The developing unit 134 is equipped with a toner cartridge 134*a*. The toner cartridge 134*a* accommodates the monochromatic toner of that developing unit 134. The toner in the toner cartridge 134*a* is supplied into the developing unit 134 so as to be used for forming the toner image. The toner cartridge 134*a* is independently replaceable such that when the toner cartridge 134*a* becomes empty, the toner cartridge 134*a* is replaceable with a new one.

An intermediate transfer unit 160 is disposed above the image forming engines 130. The intermediate transfer unit 160 includes an endless intermediate transfer belt 161, multiple support rollers 162 that support the intermediate transfer belt 161, four first-transfer rollers 163, and a cleaner 164.

The intermediate transfer belt 161 is supported by the multiple support rollers 162 and rotationally moves in a direction indicated by an arrow b by traveling on a movement path extending along the four image forming engines 130.

The four first-transfer rollers 163 are respectively disposed facing the photoconductors 131 of the image forming engines 130 with the intermediate transfer belt 161 interposed therebetween and have a function of transferring the toner images formed on the photoconductors 131 onto the intermediate transfer belt 161.

Due to the function of the first-transfer rollers 163, the toner images formed on the photoconductors 131 included in the four image forming engines 130 are sequentially transferred in a superimposed manner onto the intermediate transfer belt 161 moving in the direction of the arrow b.

After the toner-image transfer process, each photoconductor 131 undergoes a cleaning process in which the toner remaining on the surface thereof is removed therefrom by the corresponding cleaner 135.

Furthermore, each image forming engine 130 includes a memory 136. The memory 136 has stored therein various information related to that image forming engine 130, such as the color of the toner used in the image forming engine 130 and the accumulative time of use from the start of use. When the image forming engine 130 is attached to the printer 100, the printer 100 reads the contents in the memory 136 and rewrites the contents in the memory 136, where appropriate.

Due to the function of a second-transfer roller 170, the toner images sequentially transferred in a superimposed manner on the intermediate transfer belt 161 are transferred onto a sheet P transported to the position of the second-transfer roller 170 at a predetermined timing. The sheet P having the toner images transferred thereon is heated and pressed by a fixing unit 200 so that an image formed of the fixed toner images is printed on the sheet P. The sheet P is then output onto an output tray 140 by an output roller 155.

After the toner-image transfer process, the toners remaining on the surface of the intermediate transfer belt 161 are removed therefrom by the cleaner 164.

Next, a sheet transport path during a printing operation will be described.

When performing a printing operation, a sheet P is picked up by one of the pickup rollers 151 from the corresponding sheet tray 110 designated from among the three sheet trays 110 and is transported in a direction indicated by an arrow c by the transport rollers 152 and 153 until the leading edge of the sheet P reaches a timing adjustment roller 154. Subsequently, the sheet P is transported by the timing adjustment roller 154 such that the sheet P reaches the position of the second-transfer roller 170 at the same time as the toner images transferred on the intermediate transfer belt 161 reach the position of the second-transfer roller 170. Due to the function of the second-transfer roller 170, the toner images are transferred onto the sheet P. The sheet P having the toner images transferred thereon is further transported in a direction indicated by an arrow d, undergoes a toner-image fixing process by the fixing unit 200, and is output onto the output tray 140 by the output roller 155.

When performing duplex printing for printing images on both faces of the sheet P, the sheet P having the image printed only on the first face thereof is output to an intermediate point on the output tray 140 by the output roller 155. Then, the output roller 155 rotates in the reverse direction so that the sheet P output to the intermediate point is taken into the printer 100 again.

The sheet P taken into the printer 100 is transported in a direction indicated by an arrow e by transport rollers 156 and is further transported by the transport roller 153 until the leading edge of the sheet P reaches the timing adjustment roller 154. The subsequent process is the same as that when performing printing on the first face in that the sheet P having the image printed on the second face thereof is output onto the output tray 140.

A controller 190 is responsible for controlling the entire printer 100.

Next, the configuration of the fixing unit 200 will be described.

As described above, the fixing unit 200 applies heat and pressure onto the transported sheet P having the toner images transferred thereon by the second-transfer roller 170, so as to fix the toner images onto the sheet P.

The fixing unit 200 includes a heating member 210 and a pressing member 220.

The heating member 210 has a heating roller 211 and a heat source 212 provided within the heating roller 211. The heating roller 211 is rotationally driven in a direction indicated by an arrow R.

The pressing member 220 includes an endless belt 221 and a support member 222.

The endless belt 221 is in contact with the heating roller 211 and is rotationally driven by receiving a rotational driving force from the heating roller 211.

The support member 222 is disposed within the endless belt 221 at a position facing the heating roller 211 and is in contact with the inner surface of the endless belt 221 so as to nip the endless belt 221 in cooperation with the heating member 210. In order to press the endless belt 221 against the heating roller 211 over an appropriate nip region, the support surface of the support member 222 that is in contact with the inner surface of the endless belt 221 entirely has a non-circular-arc recessed shape.

The surface of the heating roller 211 according to this exemplary embodiment is covered with perfluoroalkoxy (PFA) as a release layer. When the sheet P passes through the fixing unit 200, portions of the heating roller 211 that come into contact with edges of the sheet P that extend in the sheet feed direction (i.e., opposite edges of the sheet P in the width direction orthogonal to the sheet feed direction) gradually become damaged. When printing is performed using a wide sheet after these portions become damaged, a vertical-streak-like image defect may appear in areas of the sheet that have come into contact with the damaged portions of the heating roller 211. Depending on how the user uses the printer 100, such an image defect may appear long before the number of usage (i.e., the number of printed sheets) set as the lifespan of the heating roller 211 is reached, possibly resulting in a claim from the user.

In this exemplary embodiment, a lifespan determination process that corresponds with how the user uses the printer 100 is performed in the following manner so that the heating roller 211 or the fixing unit 200 may be replaced before a claim is received from the user.

The controller 190 shown in FIG. 1 is provided with counters for individual groups corresponding to various sheet widths and a counter that counts the total number of fed sheets regardless of the sheet width.

The counter that counts the total number of fed sheets is for measuring how much the heating roller 211 becomes damaged as each sheet P is fed, without relation to damage caused by the widthwise edges of each fed sheet P. The counter for each group is for measuring streak-like damage in the heating roller 211 caused by the edges of a sheet having a sheet width belonging to that group.

FIG. 2 illustrates an example of groups corresponding to respective sheet widths.

In this example, a "group", a "sheet width (mm)", a "representative sheet size" of that sheet width, and a "count-value decrement target" are set in correspondence with one another.

A counter for group 0 is for determining the lifespan of the heating roller 211 caused by abrasion not due to the sheet width. A counter for group 1 corresponds to the widest sheet feedable through the printer 100. The sheet width decreases in a stepwise fashion from group 1 to group 6.

Even if the heating roller 211 receives streak-like damage, when a sheet wider than the damaged portions is fed, a portion of the heating roller 211 pressed by the surface of the wide sheet as the sheet is fed may sometimes recover from the damage. When a sheet wider than a sheet that has damaged the heating roller 211 is fed, the count value of the corresponding counter is decremented.

However, since the counter for group 0 is for determining the lifespan of the heating roller 211 caused by abrasion not due to the sheet width, the counter for group 0 is not a target for decrementing the count value. Furthermore, since a sheet corresponding to the counter for group 1 is the widest sheet usable in the printer 100, a sheet wider than this sheet is not fed. Therefore, the counter for group 1 is also not a target for decrementing the count value. With regard to each of the counters for group 2 to group 6, when a sheet with a sheet width corresponding to the counter is fed, the count value is incremented, and when a sheet wider than the corresponding sheet width is fed, the count value is decremented.

FIG. 3 illustrates count-value addition and subtraction coefficients relative to basis weights of sheets.

Depending on the thickness (basis weight) of a fed sheet, the heating roller 211 receives greater damage from the widthwise edges of the sheet as the basis weight increases.

As shown in the prepared table in FIG. 3, a weight coefficient (addition coefficient) corresponding to when incrementing the count value and a weight coefficient (subtraction coefficient) corresponding to when decrementing the count value are varied in accordance with the basis weight of a fed sheet.

In this case, a "whole-surface-abrasion count-value addition coefficient", an "edge-abrasion count-value addition coefficient", and an "edge-abrasion count-value subtraction coefficient" are recorded in correspondence with each "basis-weight range".

A whole-surface-abrasion count-value addition coefficient is a coefficient to be used when incrementing the count value of the counter for group 0 in FIG. 2.

For example, when the basis weight is 64 gsm or smaller, the whole-surface-abrasion count-value addition coefficient is 1.0. When the basis weight ranges between 211 gsm and 300 gsm, the whole-surface-abrasion count-value addition coefficient is 1.4. Therefore, when a sheet with a basis weight ranging between 211 gsm and 300 gsm is fed, the count value is incremented by being given a weight coefficient of 1.4 times, as compared with a case where a sheet with a basis weight of 64 gsm or smaller is fed.

An edge-abrasion count-value addition coefficient is a coefficient to be used when incrementing the count value of the counter corresponding to the sheet width of the fed sheet.

For example, when a fed sheet has a basis weight ranging between 211 gsm and 300 gsm and is of an A3 size belonging to group 2, a value obtained by multiplying the number of fed sheets by 4 is added to the count value of the counter corresponding to group 2.

An edge-abrasion count-value subtraction coefficient is a coefficient to be used when decrementing the count value of a counter corresponding to a smaller sheet width than the counter corresponding to the sheet width of the fed sheet.

For example, when a fed sheet has a basis weight ranging between 211 gsm and 300 gsm and is of an A3 size belonging to group 2, a value obtained by multiplying the number of fed sheets by 4.3 is subtracted from each of the count values of the four counters respectively corresponding to group 3 to group 6.

Although the above description is provided with reference to the number of fed sheets alone for simplicity, the length of a sheet in the sheet feed direction is also taken into consideration when incrementing or decrementing a count value.

This is because, the greater the length in the sheet feed direction, the greater the damage to the heating roller 211, and restoration of the damage to the heating roller 211 progresses.

FIGS. 4A to 4C illustrate an example in which the count value of each counter is incremented or decreased in accordance with this exemplary embodiment.

FIGS. 5A to 5F are graphs illustrating changes in the count values of the counters.

Specifically, FIGS. 5A to 5E illustrate changes in the count values of the counters for group 0 to group 4. With regard to group 5 and group 6, since the count values are constantly zero in this example, the count values therefor are shown together in FIG. 5F.

In this example, job 0 to job 3 (i.e., print commands each corresponding to one job) are shown. Job 0 refers to an initial state in which not a single job has been executed yet, job 1 refers to a first job, job 2 refers to a second job following job 1, and job 3 refers to a third job following job 2.

In FIG. 4A, a "print condition", a "group", a "sheet length (mm)", the "number of print sheets (K sheets)", a "whole-surface-abrasion count-value addition coefficient", an "edge-abrasion count-value addition coefficient", and an "edge-abrasion count-value subtraction coefficient" are shown with respect to each of job 0 to job 3.

In FIG. 4B, count values of the counters for "group 0" to "group 6" are shown together with sheet widths and representative sheet sizes with respect to each of job 0 to job 3.

In FIG. 4C, count values each obtained by calculating (sheet length)×(number of print sheets)/210 are shown as a comparative example. "210" is the length of a sheet when the sheet is of an A4 size and corresponds to short edge feed (SEF). In this case, the counting process is performed based on the length of an A4-SEF sheet as a unit.

For example, when a B4-size sheet (having a width of 257 mm by a length of 364 mm) is fed, a count value converted into A4-SEF is 1.73 (=364/210).

In other words, when printing is performed on B4-size sheets, each printed sheet is counted as 1.73 sheets.

In FIGS. 4A to 4C, the fields corresponding to "job 0" all have zero recorded therein. In other words, as shown in FIGS. 5A to 5F, the initial values for all of the counters are zero.

It is assumed that printing based on job 1 is executed from this initial state.

As shown in FIG. 4A, in job 1, an A4-SEF sheet with a basis weight of 300 gsm is used. An A4-SEF sheet belongs to group 4, as shown in FIG. 2.

As shown in FIG. 4A, the length of an A4-SEF sheet is 297 mm. In job 1, printing is to be performed on 36 A4-SEF sheets. Since the basis weight of each A4-SEF sheet used in job 1 is 300 gsm, the whole-surface-abrasion count-value addition coefficient, the edge-abrasion count-value addition coefficient, and the edge-abrasion count-value subtraction coefficient are 1.4, 4, and 4.3, respectively, according to FIG. 3.

Figure 5A:
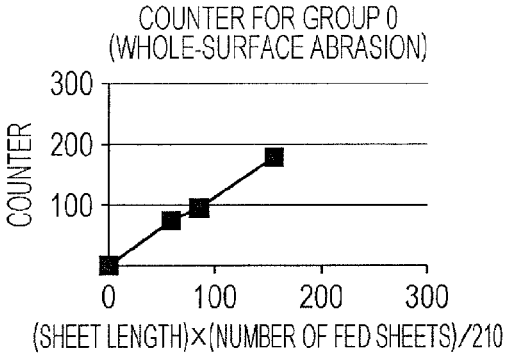
FIGS. 5A to 5F are graphs illustrating changes in the count values of the counters.
Figure 5B:
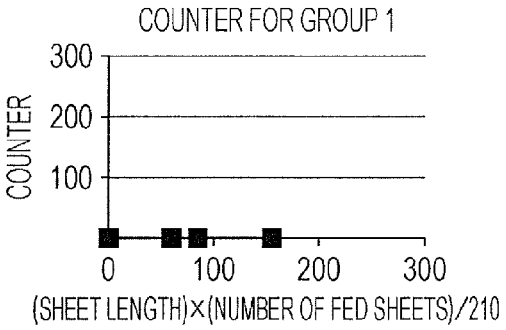
Figure 5C:
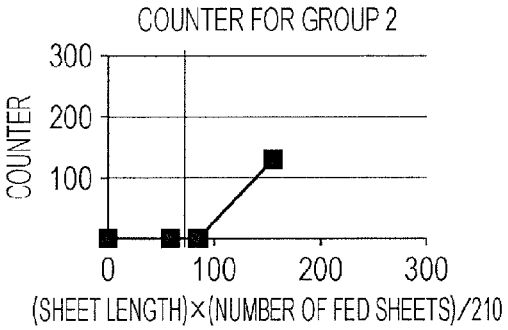

As shown in FIG. 4B, when job 1 is executed, the count value of the counter belonging to group 0 becomes 71.3=36×1.4×297/210 (see FIG. 5A), and the count value of the counter belonging to group 4 becomes 203.7=36×4×297/210 (see FIG. 5B). The count values of the counters for group 5 and group 6 are zero from the beginning, and damage to portions of the heating roller 211 corresponding to group 5 and group 6 is also zero. Therefore, the count values remain at zero since there is no recovery from damage (see FIG. 5F).

In the case of the comparative example in FIG. 4C, the count value as a result of executing job 1 becomes 50.9=36×297/210.

Next, it is assumed that printing based on job 2 is executed.

As shown in FIG. 4A, in job 2, a B4-size sheet with a basis weight of 64 gsm is used. This B4-size sheet belongs to group 3. The length of this B4-size sheet is 364 mm. In job 2, printing is to be performed on 20 sheets. In the case of this sheet with the basis weight of 64 gsm, the whole-surface-abrasion count-value addition coefficient, the edge-abrasion count-value addition coefficient, and the edge-abrasion count-value subtraction coefficient are 1, 2, and 0.6, respectively.

Figure 5D:
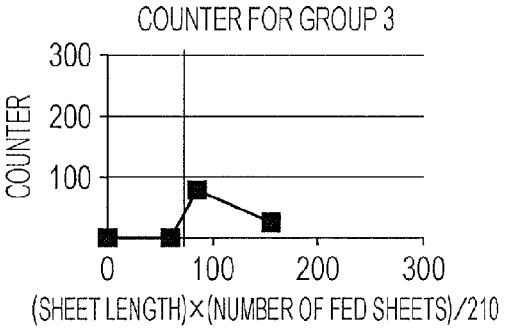

As shown in FIG. 4B, when job 2 is executed, the count value of the counter belonging to group 0 becomes 105.9=71.3+20×1×364/210 (see FIG. 5A), and the count value of the counter belonging to group 3 becomes 69.3=20×2×364/210 (see FIG. 5D).

Figure 5E:
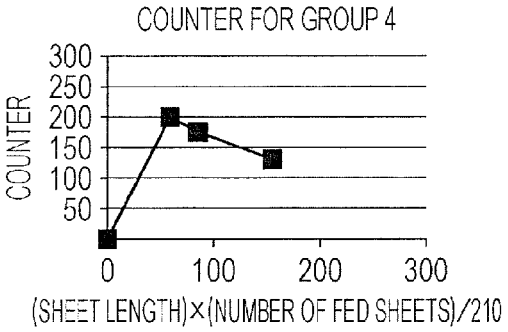
Figure 5F:
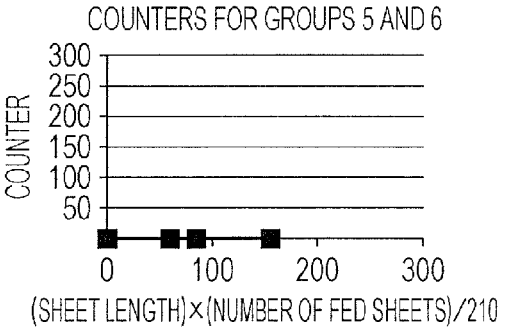

Furthermore, the heating roller 211 tends to recover from damage corresponding to group 4, and the count value of the counter corresponding to group 4 becomes 182.9=203.7−20×0.6×364/210 (see FIG. 5E).

In the case of the comparative example in FIG. 4C, the count value as a result of executing job 2 becomes 85.6=50.9+20×364/210.

Next, it is assumed that printing based on job 3 is executed.

As shown in FIG. 4A, in job 3, an A3-size sheet with a basis weight of 64 gsm is used. This A3-size sheet belongs to group 3. The length of this A3-size sheet is 420 mm. In job 3, printing is to be performed on 35 sheets. This basis weight of 64 gsm is the same as the basis weight of each sheet in job 2, and the whole-surface-abrasion count-value addition coefficient, the edge-abrasion count-value addition coefficient, and the edge-abrasion count-value subtraction coefficient are 1, 2, and 0.6, respectively.

As shown in FIG. 4B, when job 3 is executed, the count value of the counter belonging to group 0 becomes 175.9=105.9+35×1×420+210, and the count value of the counter belonging to group 3 becomes 140=35×2×420/210.

Furthermore, the heating roller 211 tends to recover from damage corresponding to group 3 and group 4, and the count values of the two counters corresponding to group 3 and group 4 become 27.3 (=69.3−35×0.6×420/210) and 140.9 (=182.9−35×0.6×420/210), respectively.

In the case of the comparative example in FIG. 4C, the count value as a result of executing job 3 becomes 155.6=85.6+35×420/210.

In this exemplary embodiment, the count value of each counter is incremented or decremented in this manner. When the count value reaches a predetermined value (e.g., a count value of 180,000), it is determined that the heating roller 211 has reached its lifespan, and a notification is, for example, displayed on a display screen (not shown) so as to prompt the user to contact a service engineer.

Alternatively, the printer 100 shown in FIG. 1 may be connected to a service center via a communication line, and the service center may be directly notified that the heating roller 211 in the printer 100 used by the user has reached its lifespan. In that case, a rule may be set so as to immediately replace the heating roller 211 or to leave the decision of whether or not to replace the heating roller 211 up to the service engineer.

As another alternative, if there are still margins for the count values of the counters corresponding to group 0 and 1 and the count value of any one of group 2 to group 6 has reached the predetermined value, the user may be prompted to command printing using a wide sheet so that the heating roller 211 may recover from the damage.

In this exemplary embodiment, a determination process that corresponds with how each user uses the printer 100 is performed with respect to the lifespan of the heating roller 211 or the fixing unit 200 in the above-described manner so that a service appropriate to each user may be provided, thereby achieving increased reliability.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A lifespan determination device that determines a lifespan of a fixing unit including a heating rotatable member and a pressing member, the heating rotatable member being equipped with a heat source, the pressing member applying pressure onto a sheet passing through a feed area between the pressing member and the heating rotatable member, the fixing unit fixing a toner image on the sheet onto the sheet as the sheet having the toner image thereon passes through the feed area, the lifespan determination device comprising:

a counting unit that includes counters for respective sheet widths, each of which is a dimension in a width direction orthogonal to a sheet feed direction of the sheet passing through the feed area, and that adds, to a count value of a counter corresponding to a sheet width of the sheet passing through the feed area, a count value obtained by multiplying the number of fed sheets having the sheet width by a first weight coefficient corresponding to a degree of damage given to the fixing unit by the fed sheet;

a determining unit that determines whether or not a count value of any one of the counters for the respective sheet widths has reached a predetermined value; and a notifying unit that provides a notification indicating that the fixing unit has reached the lifespan thereof when the determining unit determines that the count value of any one of the counters has reached the predetermined value, wherein the counting unit adds, to a count value of a counter corresponding to a sheet width of a first sheet passing through the feed area, a count value obtained by multiplying the number of fed first sheets by the first weight coefficient, and wherein the counting unit subtracts a count value, which is obtained by giving a second weight coefficient corresponding to a degree by which the fixing unit recovers from the damage given to the fixing unit by the fed sheet to the number of fed first sheets, from a count value of a counter corresponding to a sheet width smaller than the sheet width of the first sheet.

2. The lifespan determination device according to claim 1, wherein, in addition to the counters for the respective sheet widths, the counting unit further includes a second counter not dependent on the sheet widths, and wherein the counting unit adds, to a count value of the second counter, a count value obtained by multiplying the number of fed sheets passing through the feed area by a third weight coefficient corresponding to a degree of damage that is given to the fixing unit by the fed sheet but is not due to a sheet width thereof.

3. The lifespan determination device according to claim 2, wherein the third weight coefficient corresponds to a basis weight of the sheet passing through the feed area.

4. The lifespan determination device according to claim 2, wherein the third weight coefficient corresponds to a length in the sheet feed direction of the sheet passing through the feed area.

5. The lifespan determination device according to claim 1, wherein the first weight coefficient corresponds to a basis weight of the sheet passing through the feed area.

6. The lifespan determination device according to claim 1, wherein the first weight coefficient corresponds to a length in the sheet feed direction of the sheet passing through the feed area.

7. The lifespan determination device according to claim 1, wherein the second weight coefficient corresponds to a basis weight of the sheet passing through the feed area.

8. The lifespan determination device according to claim 1, wherein the second weight coefficient corresponds to a length in the sheet feed direction of the sheet passing through the feed area.

9. An image forming apparatus comprising:

the lifespan determination device according to claim 1 that determines the lifespan of the fixing unit; and the fixing unit, wherein the image forming apparatus forms the toner image on the sheet and causes the sheet to pass through the feed area so as to form an image formed of the fixed toner image onto the sheet.

10. A lifespan determination device comprising:

a counting unit including counters for respective sheet widths, each of which is a dimension in a width direction orthogonal to a sheet feed direction of a sheet passing through a feed area between a pressing member and a heating rotatable member of a fixing unit for fixing a toner image onto the sheet as the sheet passes through the feed area, wherein the counting unit is configured to add, to a count value of a counter corresponding to a sheet width of the sheet passing through the feed area, a count value obtained by multiplying a number of fed sheets having the sheet width by a first weight coefficient corresponding to a degree of damage given to the fixing unit by the fed sheet;

a determining unit configured to determine whether or not a count value of any one of the counters for the respective sheet widths has reached a predetermined value; and a notifying unit configured to provide a notification indicating that the fixing unit has reached the lifespan thereof when the determining unit determines that the count value of any one of the counters has reached the predetermined value, wherein the counting unit is further configured to add, to a count value of a counter corresponding to a sheet width of a first sheet passing through the feed area, a count value obtained by multiplying the number of fed first sheets by the first weight coefficient, and wherein the counting unit is further configured to subtract a count value, which is obtained by giving a second weight coefficient corresponding to a degree by which the fixing unit recovers from the damage given to the fixing unit by the fed sheet to the number of fed first sheets, from a count value of a counter corresponding to a sheet width smaller than the sheet width of the first sheet.

* * * * *